United States Patent [19]

Vosper

[11] Patent Number: 4,767,319

[45] Date of Patent: Aug. 30, 1988

[54] DUCT BURNER

[75] Inventor: Ralph R. Vosper, Somerset, Calif.

[73] Assignee: Coen Company, Burlingame, Calif.

[21] Appl. No.: 32,143

[22] Filed: Mar. 27, 1987

[51] Int. Cl.[4] ..... F23D 14/46

[52] U.S. Cl. ..... 431/350; 432/222

[58] Field of Search ..... 431/350, 354, 202, 347, 431/5, 171, 351, 356; 432/222; 237/50

[56] References Cited

U.S. PATENT DOCUMENTS 3,649,211 3/1972 Vosper ..... 431/350

*Primary Examiner*—Henry A. Bennet

*Attorney, Agent, or Firm*—Townsend and Townsend

[57] ABSTRACT

A burner for placement in an airstream that flows in a downstream direction comprising a gas pipe having fuel ports for admitting fuel gas into the airstream, a flame retainer for preventing a flame originating at the manifold from lifting off the fuel ports and moving down the airstream, and a flame shield extending from opposite sides of the gas pipe and away from the gas jet for shielding the flame base from the airstream. The flame shield has a baffle assembly disposed on opposite sides of the gas pipe for forming an air passage for directing a portion of the airstream to flow along the downstream surfaces of the flame shield and flame retainer. In one embodiment of the burner, the baffle assembly directs a first portion of the airstream to flow along the downstream surface of the flame shield toward the flame retainer and directs a second portion of the airstream to flow along the downstream surface of the flame shield and away from the flame retainer. Each baffle assembly includes a splitter for bisecting an upstream flow of air and for directing the bisected air flows to flow adjacent the air flowing along the downstream surfaces of the flame shield and flame retainer, respectively, for promoting the formation of two counter-rotating eddies on each side of the gas pipe. In another embodiment of the burner the baffle assembly is disposed on the ends of the flame shield for directing a portion of the airstream to flow along the downstream surfaces of the flame shield and toward the flame retainer for promoting the formation of an eddy on each side of the gas pipe which flows in a direction opposite from naturally formed eddies.

13 Claims, 2 Drawing Sheets

DUCT BURNER

BACKGROUND OF THE INVENTION

This invention relates to a burner for heat production and more particularly to a burner adapted for placement in an air duct for heating an airstream and for reducing pollutants flowing in the airstream.

Gas-fired duct burners are frequently used to raise the temperature of an air or turbine exhaust gas (TEG) stream or to incinerate gaseous or particulate matter in an airstream. However, a duct burner operating in a TEG stream may act as a carbon monoxide or oxide of nitrogen generator rather than an incinerator. The quantity of carbon monoxide incinerated by the duct burner usually is inversely related to the quantity of oxides of nitrogen generated. For example, as the amount of oxygen in the TEG stream decreases, carbon monoxide levels increase and oxide of nitrogen levels decrease. Additionally, at low firing rates, carbon monoxide levels are high whereas oxide of nitrogen levels are low. As the firing rate increases, carbon monoxide levels decrease and oxide of nitrogen levels increase, but as the firing rate is increased further, carbon monoxide levels increase and oxide of nitrogen levels decrease. As a result, it is difficult to design a burner which emits minimum levels of both pollutants.

To further complicate the problem, the exhaust gas from present-day gas turbines has a higher temperature (typically 1000° F.) and a lower oxygen content (typically 14%) than older turbines. Furthermore, many gas turbine installations are using steam injection as a means for controlling the oxides of nitrogen generated by the turbine combustor and to enhance cycle efficiency. However, the injection of steam further reduces the oxygen content of the TEG stream, and this often results in unacceptably high levels of carbon monoxide. Accordingly, it has become much more difficult for known duct burner designs to meet government standards.

SUMMARY OF THE INVENTION

The present invention is a duct burner for maintaining low levels of carbon monoxide and oxides of nitrogen in an airstream. The burner comprises a gas pipe or manifold which includes fuel ports for admitting fuel gas into the airstream, a flame retainer for preventing a flame originating at the manifold from lifting off the fuel ports and moving down the airstream, and a flame shield extending from opposite sides of the gas pipe for shielding the flame base from the relatively high velocity (2.000–10,000 fpm) of the air or TEG stream.

The flame shield has a baffle assembly disposed on opposite sides of the gas pipe for forming an air passage for directing a portion of the airstream to flow along the downstream surfaces of the flame shield and flame retainer. In one embodiment of the burner, the baffle assembly directs a first portion of the airstream to flow along the downstream surfaces of the flame shield toward the flame retainer and directs a second portion of the airstream to flow along the downstream surface of the flame shield away from the flame retainer. Each baffle assembly further includes a splitter for bisecting an upstream flow of air and for directing the bisected air flows to flow adjacent the air flowing along the downstream surfaces of the flame shield and flame retainer, respectively. In this manner, the baffle assemblies promote the formation of two counter-rotating eddies on each side of the gas manifold. During burner operation, the outer eddies provide increased retention time for carbon monoxide burning, and the inner eddies provide increased mixing to minimize the formation of oxides of nitrogen.

In another embodiment of the burner the baffle assembly is disposed on the ends of the flame shield for directing a portion of the airstream to flow along the downstream surfaces of the flame shield and toward the flame retainer for promoting the formation of an eddy on each side of the gas pipe which flows in a direction opposite to naturally formed eddies. By reversing the natural eddy pattern it is possible to increase the firing range with zero or negative carbon monoxide emissions by a factor of four or more depending on upstream oxygen levels while producing low levels of oxides or nitrogen.

DETAILED DESCRIPTION OF THE PREFERRED EMBODIMENT

Figure 1:
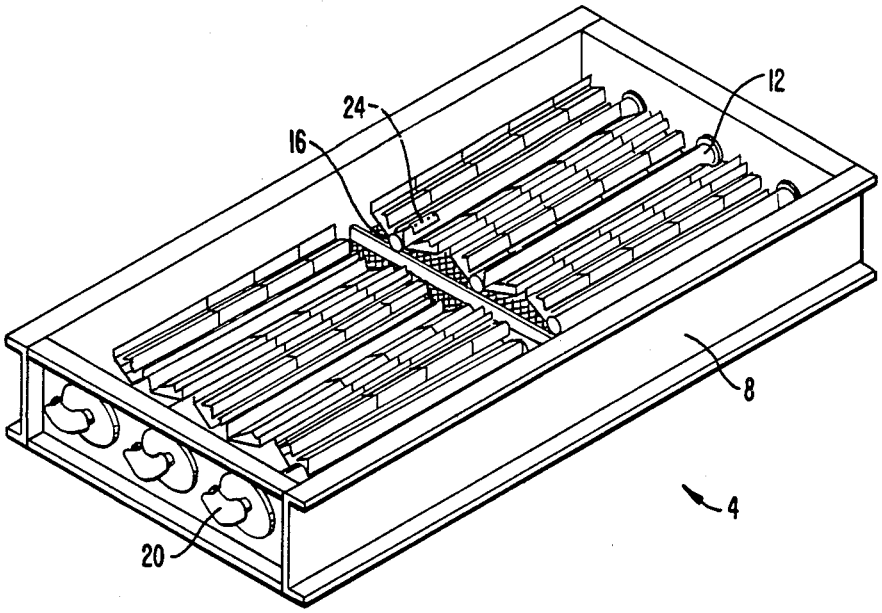
FIG. 1 is a perspective view of a segment of an air duct having installed therein a plurality of burners according to the present invention.

As shown in FIG. 1, a burner grid 4 comprises a frame 8 which may be part of an air duct. The frame supports a plurality of burner assemblies 12 for heating gases flowing through the air duct. Each burner assembly 12 comprises a central gas pipe 16 that connects to a gas source 20. Along the length of central gas pipe 16 are formed plural gas outlet openings 24 for emitting corresponding gas jets 26, shown in FIG. 2, which are spaced from one another along the pipe at intervals so as to ensure flame propagation along the length of the pipe.

Figure 2:
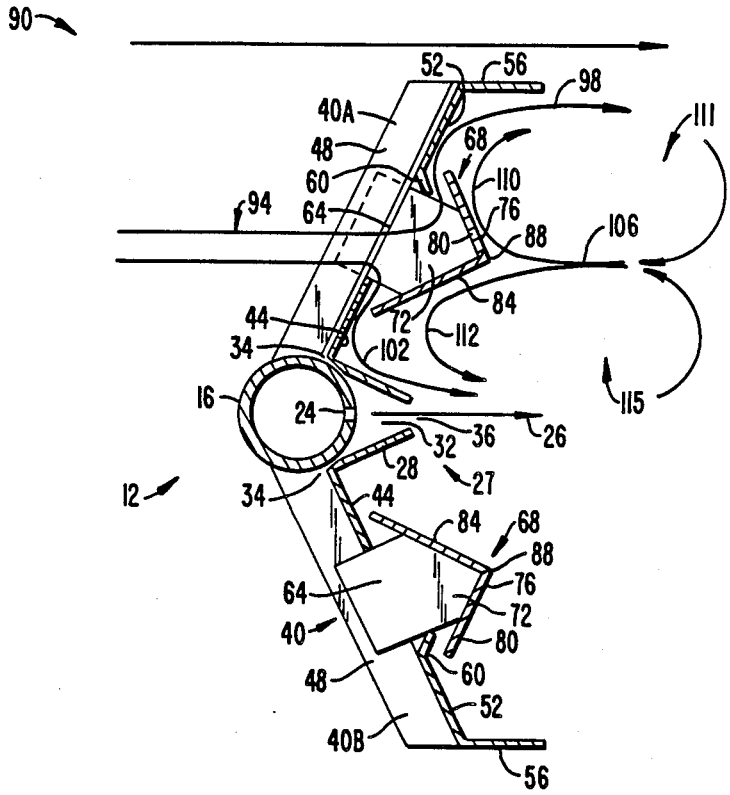
FIG. 2 is a cross-sectional view of a duct burner according to the present invention.

As shown in FIG. 2, each burner assembly 12 includes a flame retainer 27 comprising a pair of rigid members 28 disposed on opposite sides of gas outlet openings 24. The surfaces of rigid members 28 are angled for defining a generally straight and converging gas passage 32 having an outlet end 36 facing the downstream direction of the air duct. Each rigid member 28 is spaced apart from central gas pipe 16 by approximately 0.067 inch for forming air passages 34 for supplying a sufficient amount of air to the space surrounding the base of the fuel gas jets to allow for jet expansion.

The expansion of a gas jet occurs because of momentum exchange between the jet and the fluid surrounding it. If the gap were eliminated, the jet would create a partial vacuum in the space surrounding the jet and cause a backflow of gas through outlet end 36 in regions between adjacent jets. The backflow of gas creates a risk of premature ignition of the jet and overheating of flame retainer 27.

For optimum performance, it is desirable that the gas jet barely squeeze through outlet end 36 and form small eddies immediately downstream of outlet end 36 to stabilize the flame. If the jet diameter at the outlet end is too small, the eddies will not form, and if the jet diameter at the slot is too large, the jet will be splayed into adjacent jets and forward momentum will be decreased. Since normal jet expansion is usually approximately 11° on each side, with no expansion for the first three hole diameters, optimal results are obtained when the ratio of the width of outlet end 36 to the distance between gas outlet openings 24 and outlet end 36 is approximately 0.45. These measurements allow for a stable flame under a wide range of operating conditions. Applicant currently believes that satisfactory results are obtained when this ratio is in the range of between about 0.39 to 0.49.

Burner assembly 12 further includes a flame shield 40 comprising an upper flame shield 40A and a lower flame shield 40B. Upper flame shield 40A and lower flame shield 40B comprise a first air-impervious member 44 affixed to each rigid member 28 (and forming an angle therewith as shown in FIG. 2) and a second air-impervious member 52 having an outer portion 56, which is generally parallel to the flow of air in the duct, and an inner portion 60 whose function is described in more detail below. Each second air-impervious member 52 is spaced apart from its associated first air-impervious member 44 by a support 48 which extends from central gas pipe 16 for defining an air opening 64 for allowing a portion of the airstream to pass therethrough.

Disposed between each first air-impervious member 44 and each second air-impervious member 52 is a baffle assembly 68 comprising a baffle support 72 and an angular baffle plate 76. Baffle plate 76 includes an outer baffle panel 80 and an inner baffle panel 84 affixed to each other and forming a corner 88.

Operation of the forced double eddy duct burner may be understood by referring to FIG. 2 wherein burner assembly 12 is shown operating within an airstream generally designated as 90. As shown in FIG. 2, a portion 94 of airstream 90 passes through each air opening 64 in baffle assembly 68. Outer baffle panel 80 forms with inner portion 60 of second air-impervious member 52 a passage for directing a portion 98 of air flow 94 to flow generally parallel to the downstream surface of second air-impervious member 52. Similarly, inner baffle panel 84 forms with first air-impervious member 44 a passage for directing a second portion 102 of airstream 94 to flow generally parallel to the downstream surfaces of first air-impervious member 44 and rigid member 28.

The momentum of air flows 98 and 102 promote a recirculating pattern wherein a portion of the airstream 106 is drawn upstream toward baffle assembly 68. When recirculating airstream 106 contacts angular baffle panel 76, it is split by corner 88 into an outer eddy airstream 110 and an inner eddy airstream 112. Outer eddy airstream 110 flows along the downstream surface of outer baffle panel 80 and then adjacent airstream 98 to promote the formation of an outer eddy 111. Similarly, inner eddy airstream 112 flows along the downstream surface of inner baffle panel 84 and adjacent airstream 102 to promote the formation of an inner eddy 115. The outer eddy provides increased retention time of the airstream for carbon monoxide incineration, and the inner eddy provides for increased mixing of the airstream to minimize the formation of oxides of nitrogen.

In the preferred embodiment, the flame shield defines an angle of between 120° and 140°. A lesser angle reduces the tendency for eddy formation, whereas an increase of the angle reduces the effective protection of the eddies from the airstream.

Figure 3:
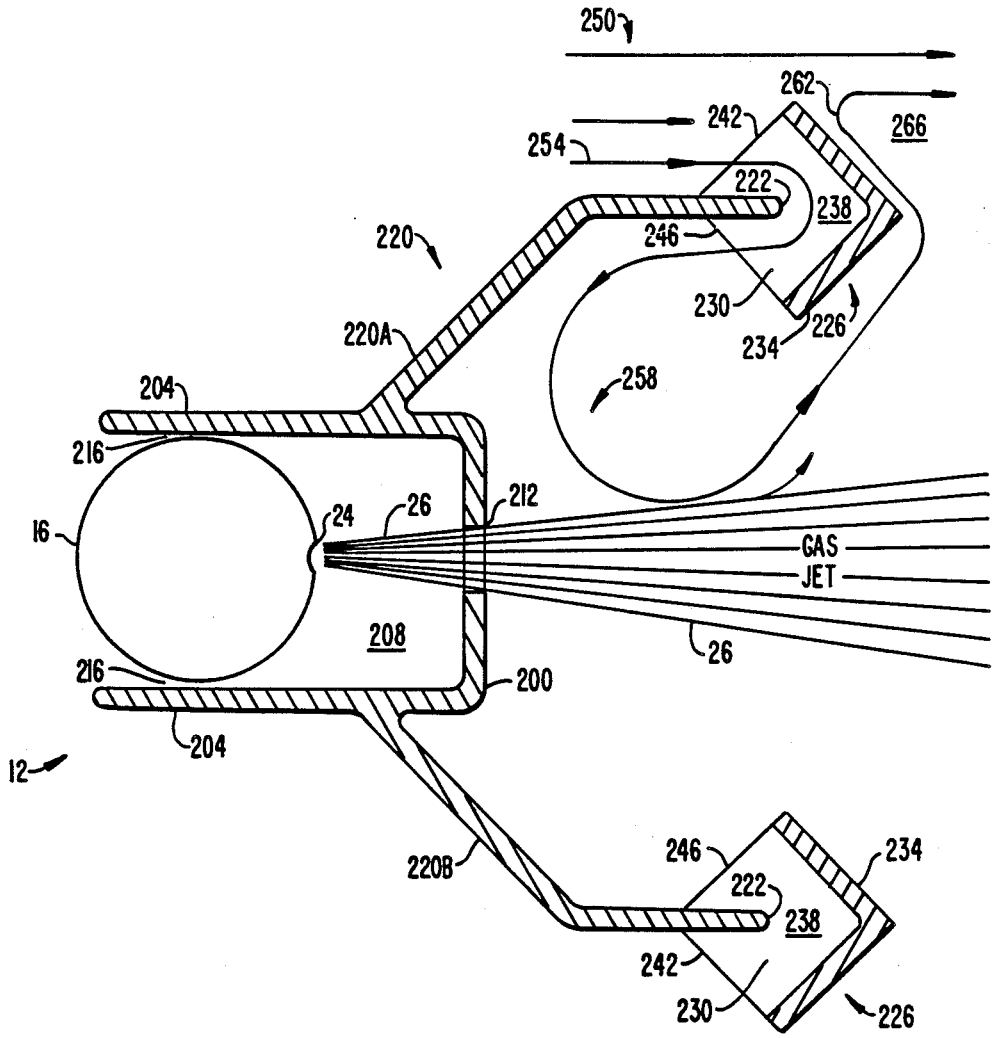
FIG. 3 is a cross-sectional view of an alternate embodiment of a duct burner according to the present invention.

FIG. 3 is a cross-sectional view of an alternative embodiment of a duct burner according to the present invention. As shown in FIG. 3, each burner assembly 12 includes a generally rectangular flame retainer 200 having walls 204 disposed on opposite sides of gas pipe 16. Flame retainer 200 forms a gas chamber 208 for receiving the gas jet 26 emitted from gas outlet openings 24. Flame retainer 200 includes a plurality of apertures 212 for directing gas jet 26 into the air duct. Walls 204 are spaced apart from central gas pipe 16 by approximately 0.03 inch and form air passages 216 for supplying a sufficient amount of air to the space surrounding the base of the fuel gas jets to allow for jet expansion. This gap may be eliminated when using hydrogen fuel.

Burner assembly 12 further includes a flame shield 220 comprising an upper shield 220A and a lower flame shield 220B extending from flame retainer 200 on opposite sides of the gas jet and terminating in ends 222. Disposed at the ends 222 of upper flame shield 220A and lower flame shield 220B are baffle assemblies 226 comprising a baffle support 230 and an angular baffle plate 234. Baffle assemblies 226 form with ends 222 of flame shield 220 an air passage 238 having an inlet opening 242 facing in the upstream direction and an outlet opening 246 for directing a portion of the airstream to flow generally parallel to the downstream surface of flame shield 220 and toward flame retainer 200.

Operation of this embodiment of duct burner 12 may be understood by referring to FIG. 3 wherein burner assembly 12 is shown operating within an airstream generally designated as 250. An air flow 254 of airstream 250 passes through inlet opening 242 in baffle assembly 226. Outlet opening 246 directs air flow 254 to flow generally parallel to the downstream surface of flame shield 220 and toward flame retainer 200 wherein the momentum of gas jet 26 promotes the formation of an eddy 258 on each side of the gas jet. Eddies 258 rotate in a direction opposite from naturally formed eddies for increasing retention time and mixing of the airstream for carbon monoxide incineration and the reduction of the formation of oxides of nitrogen.

The momentum of eddy 258 draws a portion of gas jet 212 back toward main airstream 250. When air flow 254 reaches baffle plate 234 a wake 262 is formed in a region 266 which acts as a flame stabilizing region.

While the above is a complete description of a preferred embodiment of the present invention, various modifications may be employed. For example, the lower flame shield 40B in the first embodiment may be omitted and a horizontal plate put in its place so that only a single set of counter-rotating recirculating eddies form above the gas jet 26. Furthermore, baffle 234 in the second embodiment may be of any shape which promotes a reversal of natural eddy rotation and which forms a flame stabilizing region. Consequently, the description should not be used to limit the scope of the invention which is properly set out in the appended claims.

What is claimed is:

1. A burner for placement in an airstream that flows in a downstream direction through a duct comprising:

a flame retainer having an air impervious surface facing in the downstream direction and having a gas passage therethrough;

means disposed upstream of the flame retainer for directing a gas jet toward and through the gas passage;

a rigid member connected to the flame retainer, extending away from the gas jet, and having an air-impervious surface downstream thereof; and means connected to the rigid member for directing a portion of the airstream to flow on the side of and generally parallel to the downstream surface of the rigid member.

2. The apparatus according to claim 1 further comprising means for directing air into the gas passage for allowing expansion of the gas jet therein.

3. The apparatus according to claim 1 wherein the rigid member comprises a first air impervious member connected to the flame retainer and extending away from the gas jet; and a second air impervious member connected to the first air impervious member;

wherein the airstream directing means has a first outlet opening for directing a portion of the airstream to flow generally parallel to the downstream surface of the first air impervious member and toward the flame retainer.

4. The apparatus according to claim 3 wherein an end portion of the second air impervious member is generally parallel to the airstream.

5. The apparatus according to claim 3 wherein the airstream directing means is connected to an end of the second air impervious member, the airstream directing means having an inlet opening in fluid communication with the airstream and the first outlet opening directing a portion of the airstream to flow upstream, on the side of and generally parallel to the downstream surfaces of the first and second air impervious members and toward the flame retainer for forming eddies which rotate opposite the direction of rotation of naturally formed eddies.

6. The apparatus according to claim 3 wherein the airstream directing means has a second outlet opening for directing a portion of the airstream to flow on the side of and generally parallel to the downstream surface of the second air impervious member and away from the flame retainer.

7. The apparatus according to claim 6 wherein the ratio of the area of the first outlet opening to the area of the second outlet opening is approximately 0.25.

8. The apparatus according to claim 6 wherein the airstream directing means further comprises:

an angular member disposed downstream of the rigid member and having a corner pointing in the downstream direction for directing a first portion of air flowing in the upstream direction to flow adjacent the airstream flowing generally parallel to the downstream surface of the first air impervious member and for directing a second portion of air flowing in the upstream direction to flow adjacent to the airstream flowing generally parallel to the downstream surface of the second air impervious member for promoting the formation of a pair of counter-rotating eddies on a side of the gas jet.

9. The apparatus according to claim 2 wherein the flame retainer comprises a pair of second rigid members disposed on opposite sides of the gas jet and extending toward the downstream direction for forming the gas passage, the gas passage being generally straight and converging from the inlet end to the outlet end, and the downstream ends of the second rigid members forming a slot for defining the outlet end of the gas passage.

10. The apparatus according to claim 9 wherein the ratio of the distance between the downstream ends of the second rigid members to the length of the gas passage is approximately 0.45.

11. The apparatus according to claim 10 wherein the upstream ends of the second rigid members are spaced apart from the gas jet directing means by approximately 0.067 inch for directing the air into the gas passage for allowing expansion of the gas jet therein.

12. A burner for placement in an airstream that flows in a downstream direction through a duct comprising:

means for directing a gas jet in the downstream direction;

a pair of rigid members disposed on opposite sides of the gas jet for forming a gas passage having an inlet end in fluid communication with the gas jet directing means and a downstream facing outlet end;

means for directing air into the gas passage for allowing expansion of the gas jet therein;

a flame shield comprising:

a first air-impervious member connected to each rigid member and extending away from the gas jet in a downstream direction;

a senond air-impervious member connected to each first air-impervious member and extending in a downstream direction; and means connected to the flame shield for forming an air passage having a first outlet opening for directing a portion of the airstream to flow adjacent to, on the side of, and generally parallel to the downstream surface of each first air-impervious member and toward the rigid members and having a second outlet opening for directing a portion of the airstream to flow adjacent to, on the side of, and generally parallel to the downstream surface of each second air-imperviious member and away from the rigid members; and an angular member disposed downstream of each first air-impervious member and each second air-impervious member and having a downstream pointing corner for directing a first portion of air flowing in the upstream direction to flow adjacent the airstream flowing generally parallel to the downstream surface of each first air-impervious member and for directing a second portion of air flowing in the upstream direction to flow adjacent to the airstream flowing generally parallel to the downstream surface of each second air-impervious member for promoting the formation of first and second pairs of counter-rotating eddies on opposite sides of the gas jet.

13. A burner for placement in an airstream that flows in a downstream direction through a duct comprising:

a flame retainer having an air impervious surface facing the downstream direction and having a gas passage therethrough;

means disposed upstream of the flame retainer for directing a gas jet toward and through the gas passage;

means for directing air into the gas passage for allowing expansion of the gas jet therein;

a pair of rigid members connected to the flame retainer on opposite sides of the gas jet and extending away from the flame retainer in a downstream direction; and means, connected to the ends of the rigid members, for directing a portion of the airstream to flow upstream, adjacent to, on the side of, and generally parallel to the downstream surface of each rigid member and toward the flame retainer for forming eddies which rotate opposite the direction of rotation of naturally formed eddies.

* * * * *